US005713471A

United States Patent [19]

Gueret

[11] Patent Number: 5,713,471

[45] Date of Patent: Feb. 3, 1998

[54] UNIT FOR THE PACKAGING AND PRESENTATION OF AT LEAST ONE PRODUCT SUCH AS A MAKE-UP PRODUCT

[75] Inventor: Jean-Louis Gueret, Paris, France

[73] Assignee: L'Oreal, Paris, France

[21] Appl. No.: 444,269

[22] Filed: May 18, 1995

[30] Foreign Application Priority Data

May 19, 1994 [FR] France ..... 94 06136

[51] Int. Cl.[6] ..... B65D 71/00

[52] U.S. Cl. ..... 206/581; 132/294; 132/314; 206/805

[58] Field of Search ..... 206/581, 823, 206/804, 523, 524, 738, 805; 132/293, 294, 295, 301, 303, 314

[56] References Cited

U.S. PATENT DOCUMENTS

| | | | |
|---|---|---|---|
| 1,194,187 | 8/1916 | Kendall | 132/303 X |
| 1,299,733 | 4/1919 | Kendall | 132/294 |
| 1,409,867 | 3/1922 | Kendall | 132/294 |
| 1,616,376 | 2/1927 | Kendall | 132/293 |
| 1,626,613 | 5/1927 | Kendall . | |
| 1,775,107 | 9/1930 | Lynne | 132/301 |
| 2,390,568 | 12/1945 | Witherspoon | 132/303 |
| 2,797,839 | 7/1957 | Root . | |
| 4,538,725 | 9/1985 | Glover et al. | 132/294 X |
| 4,595,028 | 6/1986 | Yuhava | 132/314 |
| 4,681,127 | 7/1987 | Gueret | 132/301 |
| 4,874,106 | 10/1989 | Robbins, III . | |
| 5,092,354 | 3/1992 | Pacelli, Jr. | 132/294 |
| 5,199,451 | 4/1993 | Montoli . | |
| 5,211,302 | 5/1993 | Tiramani | 206/581 X |
| 5,358,101 | 10/1994 | Lombardi | 206/523 X |
| 5,373,862 | 12/1994 | Blachut | 132/294 |

FOREIGN PATENT DOCUMENTS

| | | |
|---|---|---|
| 0519482 | 12/1992 | European Pat. Off. . |
| 2585935 | 2/1987 | France . |
| 2686784 | 8/1993 | France . |
| 9300792 | 5/1993 | Germany . |
| 2156784 | 10/1985 | United Kingdom . |

*Primary Examiner*—Bryon P. Gehman
*Attorney, Agent, or Firm*—Oblon, Spivak, McClelland, Maier & Neustadt, P.C.

[57] ABSTRACT

A unit for the packaging and presentation of at least one product of a solid or semi-solid consistency. The product is received in a cavity of a supporting element and the cavity is delimited by a substantially flat bottom and by a side wall substantially perpendicular to the bottom. Provision is made for an elastic device for holding the product in position in the cavity between at least one portion of the side wall delimiting the cavity and the product, allowing the product to be extracted from the cavity at will, and the introduction of fresh product to be placed in position.

32 Claims, 3 Drawing Sheets

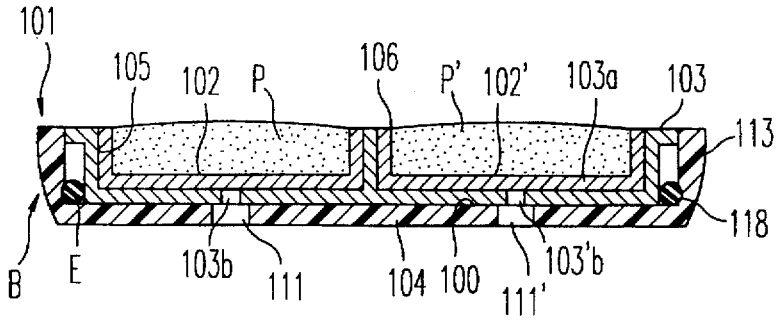
FIG. 2
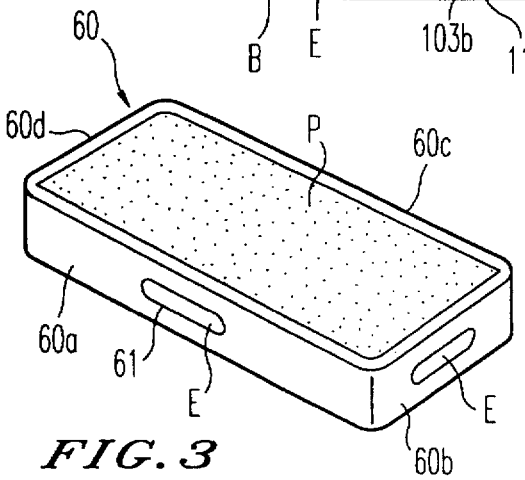
FIG. 3
FIG. 4
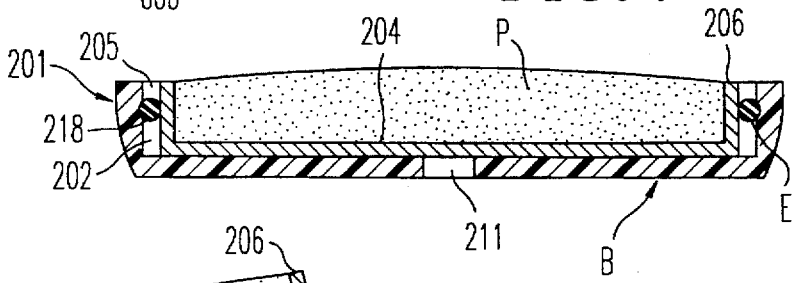
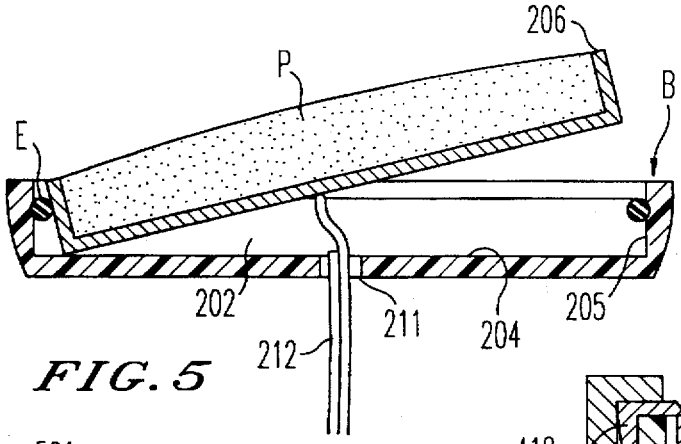
FIG. 5
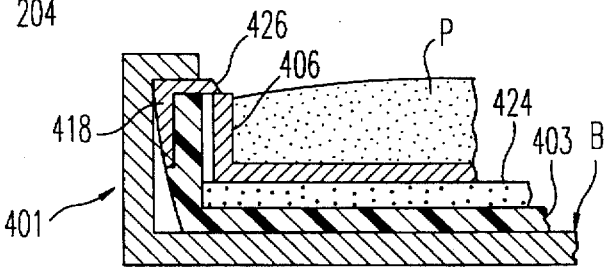
FIG. 7
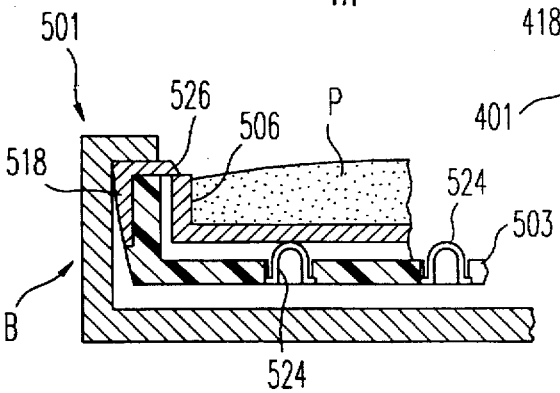
FIG. 8

UNIT FOR THE PACKAGING AND PRESENTATION OF AT LEAST ONE PRODUCT SUCH AS A MAKE-UP PRODUCT

BACKGROUND OF THE INVENTION

1. Field of the Invention

The present invention relates to a unit for the packaging and presentation of at least one product, of a solid or semi-solid consistency such as a cosmetic product, for example in make-up compacts enclosing at least one solid, friable product obtained by compaction, or by casting a powder into a holder. Such solid products may be, for example, cheek blushers, eye shadows, make-up foundations, etc., and such semi-solid products, or even semi-liquid products may be, for example, make-up foundations having the appearance of a cream but which do not flow.

2. Description of the Related Art

The conventional make-up compacts generally have a base having one or several shaped cavities, each intended to receive a solid make-up product, for example packaged in a respective pan. Because of the unequal rate at which these different make-up products contained in the compact are consumed, it is desirable that a pan of a solid product could be easily extracted from its cavity and be replaced by a new pan of the product.

Similarly, it is desirable that the user should be able to compose a set of make-up products, the color shade of which she has herself chosen. In parallel with the interchangeability of the pans, it is necessary to ensure a solid fixing of the pans in their cavities.

For this purpose, in FR-A, 2 585 935, the Applicant has already proposed to place, into a make-up compact comprising a base and a lid articulated to this base, pans each of which contains a solid product and is placed into a cavity inside the compact, provision being made for an articulated lever beneath each pan to be operated to allow the user to extract a pan of a used-up product.

However, this make-up compact has the drawback that it is difficult to ensure a good hold of a pan in its cavity, because the tolerances of the pans are very variable; this is due to the fact that they are generally made of a metallic material, and that during their filling they are subjected to considerable deformations. Because of these variable dimensions, it may be difficult, even impossible, to insert a pan into its cavity, or the pan may not have a size sufficient to ensure a good hold in its cavity by friction. Moreover, if the compact is subjected to a shock, the products tend to crumble and even to break.

SUMMARY OF THE INVENTION

The present invention makes it possible, in particular, to remedy these drawbacks. For this purpose, an object of the present invention is to provide for a unit for the packaging and presentation of an assembly for a solid product, such as a make-up compact capable of receiving at least one block of a solid product, the product being held in an elastic manner in a cavity and it being possible for this product to be extracted by the user from the cavity by a simple manipulation and to be replaced by a fresh solid product.

Thus the present invention provides for a new industrial product constituted by a unit for the packaging and presentation of at least one product, of a solid or semi-solid consistency. This product is received in a cavity of a supporting element and the cavity is delimited by a substantially flat bottom and by a side wall substantially perpendicular to the bottom. In the present invention, provision is made for an elastic, flexible, shock resistant and in all directions deformable means for ensuring the holding in position of the product in the cavity, as well as the extraction of the product from the cavity and the setting in position of a new product at will, this means being situated between at least one portion of the side wall delimiting the cavity and the product.

Due to the elastic hold, the products accommodated in the compact according to the present invention may have variable dimensions, the elastic means ensuring in particular, a certain compensation for play. Moreover, the elastic means ensures a better resistance to shocks or vibrations which may occur during carriage.

This elastic, shock-resistant means has the characteristic of showing two elasticities: a first elasticity due to the material, and which is a compression flexibility, and a second elasticity, which is an elongation elasticity. The elastic, shock-resistant means is therefore deformable in all space directions. In particular, when it is horizontally compressed, it expands vertically and vice versa.

The packaging unit in accordance with the invention may be a case for a make-up product, paints, or even shoe polish.

A unit for making up the eyes, for example, for the eyelids generally comprises several products of different colors, according to the user's preference for a precise shade, one corresponding product will be used up before the others. Due to the invention, it will be possible to replace the used-up product easily with a fresh one. Similarly, when a given shade is no longer fashionable, the user will be able, while keeping her make-up unit, to remove the unfashionable shades and to place therein new products of a preferred color. Finally, the user will be able to compose the colors for her compact at the time of purchase.

Advantageously, the holder for the solid or semi-solid product is constituted by a pan in which a pulverulent composition has been compacted; it is also possible to fill the pan by casting a pulverulent composition in suspension in a solvent, then optionally to evaporate the solvent, in order to solidify the product, otherwise it may be kept semi-fluid.

The unit according to the present invention preferably comprises, in addition to one or several pans, a base which constitutes or carries the supporting element as the case may be, the means for the elastic hold of each product then ensuring the elastic hold of each pan in this supporting element so that the products are elastically suspended in the cavities formed by the supporting element.

The cavity may have a parallelepiped shape with rounded angles, it being possible for the cross section to be square or rectangular; as a variant, it is possible to choose a circular or oval cross-section.

Advantageously, the elastic hold may be constituted by an O-ring. This O-ring may be accommodated in four slots, cut for example halfway up in the four corners of the cavity when the latter has a rectangular or square cross-section, at the level of the side wall. This O-ring can also be placed above the product, for example at its periphery, in four slots cut above the product in four corners of the cavity.

According to an advantageous aspect of the invention, the O-ring may be made of a thermoplastic or vulcanized elastomer which may, if required, take the form of a foam.

The hardness of this elastomeric material advantageously. has a hardness chosen within the range of 15 Shore A to 25 Shore D.

Advantageously, this material is chosen from silicone elastomers, natural rubbers, synthetic rubbers, elastomers of polyethylene/polypropylene/polyester, elastomers of polyurethane, elastomers of polystyrene, and polyether amide block elastomers.

According to a first embodiment of the invention, the supporting element is constituted by an intermediate plate delimiting the cavity by a side wall, the bottom of the product-receiving cavity being formed by the base and/or by the plate, according to whether the plate has or has not a bottom, the elastic holding means then ensuring the elastic hold of the pan in the plate.

According to this first embodiment of the invention, the elastic holding means may be joined to the intermediate plate. According to a variant of the embodiment, the elastic holding means may be joined to the pan.

According to a second embodiment, the supporting element has a base; the side wall and the bottom of the cavity form part of an intermediate plate, the elastic holding means ensuring the hold of the intermediate plate in the base; this plate may, if required, comprise a pan for the product, and which can be fixed, either by bonding or by means of a second elastic holding means, as defined above. According to this second embodiment, the elastic holding means may be joined to the plate or to the base.

In a particular way, the side wall of the pan may have at least one zone to which the O-ring of an elastically deformable material has been applied, for example by double injection or by casting. This variant may or may not be used in the presence of the intermediate plate.

The pan may be made of metal, or else of a thermoplastic material in the conventional way.

Advantageously, the pan may be provided with a catch engagement bead intended to be accommodated in a zone situated between the bottom of the cavity and the elastic holding means carried by the supporting element.

According to a third embodiment, the cavity is formed in the base and the elastic holding means directly receive the pan for the product without the use of an intermediate plate, so as to hold the pan directly in the base, the base then serves as the supporting element. According to this third embodiment, the elastic holding means is joined to the pan or to the base.

In some cases, it will be possible to make provision between the supporting element and the product, and for example between the plate and the base or between the base and the pan, for a complementary compressible means such as a foam or molded-on spikes made of a deformable material, in particular an elastomeric material, with a view to an additional compensation of play and for protection against vibrations.

To enable the user to replace at will one pan of a product with another, provision may be made for a means facilitating this operation:

According to a first variant, the supporting element is provided at its bottom with a hole for the extraction of the product, allowing a slender or pointed element to be introduced, which then produces the ejection of the product when it has to be changed. This slender element may be a hairpin or a paper clip. When the pan of the product is accommodated in an intermediate plate having a bottom, this slender element must pass through a first hole arranged in the base, and a second in the plate.

According to a second variant of the invention, the supporting element is provided with a pivoting means for extracting the pan. This pivoting extraction means may be a lever arm, one arm whereof is capable of being actuated by the user, and the second arm whereof is accommodated beneath the zone of the pan and is capable of raising the latter when the first arm is actuated. Such an ejecting means is described in FR-A 2 585 935.

The present invention also concerns a unit for the packaging and the presentation of at least one make-up product of a solid consistency, characterized in that it comprises a unit such as described above, and in that it is possible for the make-up to be a compacted or cast product, such as cheek blushers, eye shadows, blushers, perfumed powders, etc.

Therefore, the present invention provides for a unit for packaging and presenting at least one product of a solid or a semi-solid consistency. The unit comprising a supporting element having a cavity for receiving the at least one product, the cavity being delimited by a substantially flat bottom and a side wall which is substantially perpendicular to the substantially flat bottom; and an elastic holding means for ensuring a holding in position of the product in the cavity, permitting an extraction of the product from the cavity, and a setting in position of a new product, the holding means being flexible, shock-resistant and deformable in all directions, the holding means being situated between at least one portion of the side wall which delimits the cavity and the product.

The description given below relates to a make-up compact, but it goes without saying that the invention has a much wider application.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a longitudinal sectional view of a compact in accordance with a second embodiment of the invention;

FIG. 3 shows a view in an exploded perspective of a solid product block packaged in a pan provided with molded-on elastic holding means in accordance with a variant of the embodiment;

FIG. 4 shows a section similar to that of FIG. 2, the elastic holding means being situated between the base of the compact and the pan, according to a third embodiment;

FIG. 5 is a schematic view of the section of FIG. 4, the pan of a solid or semi-solid product being disposed in the stage of being extracted by means of a tool;

FIG. 7 shows a section of another variant of the embodiment of the unit of the invention; and FIG. 8 shows a section of yet another variant of the embodiment of the unit of the invention.

DESCRIPTION OF THE PREFERRED EMBODIMENTS

Figure 1:
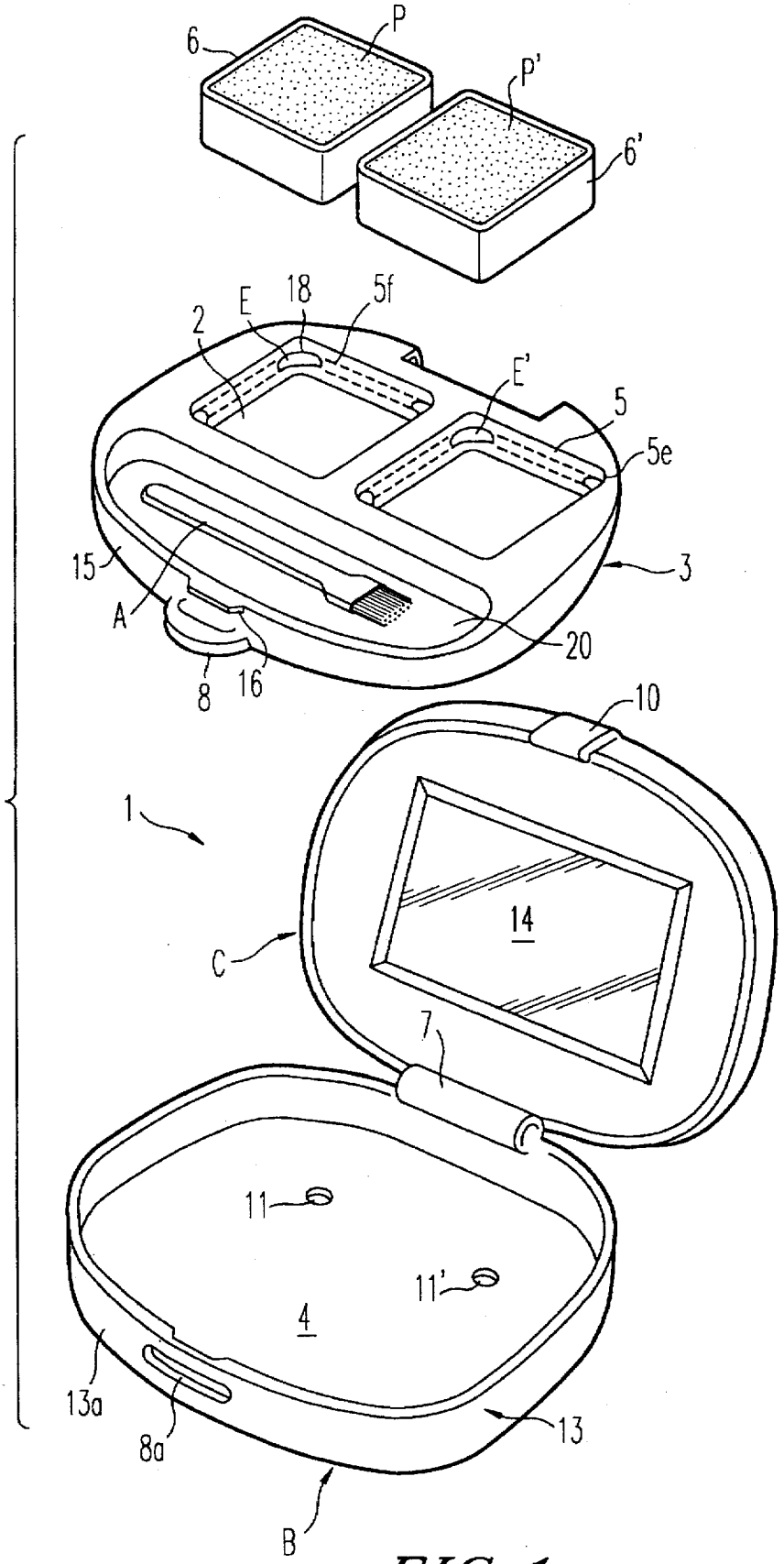
FIG. 1 is a view in perspective of a make-up compact in accordance with a first embodiment of the invention, shown in its open position with two product pans just before they are being positioned in the compact.

Referring now to the drawings, wherein like reference numerals designate identical or corresponding parts throughout the several views, and more particularly to FIG. 1 thereof, a unit for the packaging and presentation of a make-up product P, P' represented in FIG. 1 is constituted by a compact 1 comprising a base B, a lid C and an intermediate plate 3 accommodated in the base B. These three parts are, for example, molded from a plastic material and substantially have the shape of a rectangle with rounded corners; they have a constant thickness, except at their periphery where they progressively become thinner to constitute a rounded end edge.

The base B has a bottom 4 which is surrounded by a side wall 13 disposed over the whole periphery of the bottom 4. Similarly, the intermediate plate 3 without a bottom has a side wall 5 which delimits one or several cavities 2, 2', respectively receiving a pan 6, 6' which may be made of metal or of a thermoplastic material. In FIG. 1, provision has been made for two cavities 2, 2'; it is however possible to make provision for only one cavity, or three, four, five or more according to the size of the unit.

Each pan 6, 6' is filled with a solid or semi-solid product P, P' obtained for example, by the compacting of a pulverulent composition or the casting of a liquid composition which solidifies by cooling or evaporation of a solvent.

In the example considered, the cavities 2, 2' have a parallelepiped shape with a square cross-section, delimited by the side walls 5 of the plate, each of the four corners 5*e* of the parallelepiped having a slot 5*f* to cause elastic holding means E, E' to be visible therein.

These means E, E' are each constituted by an O-ring 18 made of an elastomer, for example an elastomer chosen from silicone elastomers, natural rubbers, synthetic rubbers, elastomers of polyethylene/polypropylene/polyester, elastomers of polyurethane, elastomers of polystyrene and polyether amide block elastomers.

Thus, each pan 6, 6' placed into a cavity 2, 2' is never in any intimate contact with the side wall 5, but is elastically suspended by means of the four zones of each O-ring appearing in the slots 5*f*.

Due to the disposition of these four visible zones of the elastic rings E, E', each pan 6, 6' is elastically held in position in its cavity 2, 2', thus allowing attenuation of shocks which are liable to break the compacted product during the carriage of the unit. The side of the pan 6, 6' which is in contact with the elastic holding means E, E' may, moreover, have striations or roughened portions (not shown) so as to ensure a better hold of each pan in the cavity 2, 2' in the region of the rings E, E'.

On its front side 13*a*, the base B has an opening 8*a*. Moveover, the subassembly formed by the base B and the plate 3 has, on the opposite side to the side 13*a*, an articulation means 7 allowing the base to be articulated relative to the lid C. Thus a first part of the articulation 7 forming a hinge is carried by the lid; the second part, complementary to the first, may be carried by the base B, as shown, or by the plate 3. Inside the central portion of the lid C, provision may be made for a mirror 14. On its edge on the opposite side to the hinge 7, the lid C is, moreover, provided with a catch engagement means 10 cooperating with a complementary catch 16 carried by an elastically deformable side 15 of the plate 3 and whose manipulating element 8 emerges from the opening 8*a* cut on the front side 13*a* of the base B.

Moreover, the bottom 4 has a hole 11, 11' allowing a slender tool, such as a hairpin or paper clip, to be introduced for the extraction of the pan 6, 6' when the latter has to be changed (see FIG. 5).

Additionally, the plate 3 may include a recess 20 intended to receive an applicator A, such as a brush or a puff for the make-up products.

If required, the plate 3 may be joined to the base B by bonding or any other means, or be suspended in the base B by means of an elastic means having the form of the O-ring 118 (see FIG. 2).

FIG. 2 shows a longitudinal section of a second embodiment of the invention. The parts that are the same as in FIG. 1 or perform a similar function bear the reference numerals of this figure, increased by 100. Their description will therefore be only partly repeated.

In FIG. 2, a unit 101 includes a base B forming a cavity 100 delimited by a bottom 104, and a side wall 113. In this cavity 100 there is disposed a plate 103 having an outer side wall 105 and a bottom 103*a*. In the peripheral space between the wall 105 of the plate 103 and the wall 113 of the base B there is disposed an elastic holding means E, in the form of an O-ring 118 of the same structure as the ring 18 of FIG. 1. This ring 118 is joined to the wall 105. The plate has cavities 102, 102', each intended to receive a pan 106, 106' of the product P, P', which pan may be fixed by bonding, welding or catch engagement, or yet again be suspended by an O-ring, as shown in FIG. 1.

The base B is provided with two extraction holes 111, 111' whose function will be explained more explicitly during the description of FIG. 5. Similarly, the bottom 103*a* has two holes 103*b*, 103*b*' opposite the holes 111, 111'.

FIG. 3 shows, according to a variant of the embodiment, a pan 60 formed by a bottom and four side walls 60*a*–60*d*, each wall having a zone with an extra thickness 61 of molded-on elastomer, these zones 61 with the extra thickness constituting the elastic holding means E of the pan 60, and are thus in a flexible bearing contact with the wall 5 of the cavity 2 of the intermediate plate 3 (FIG. 1), or with the wall 205 of the base B in the absence of the plate (see FIG. 4), after the pan 60 has been positioned in this cavity. In this case, the wall 5 or 205 is not provided with an O-ring.

FIG. 4 shows a longitudinal section of a third embodiment of the invention. The parts that are the same as in FIG. 1 or perform a similar function bear the reference numerals of this Figure, increased by 200. Their description will not be repeated.

In this embodiment, the compact does not have an intermediate plate. Thus the unit 201 has a base B forming a cavity 202 delimited by a bottom 204 and a side wall 205. In this cavity, there is disposed a pan 206 filled with a compact powder P which is elastically held in the cavity 202 by an O-ring 218 made of an elastomer.

FIG. 5 shows a view similar to FIG. 4, wherein the pan 206 is in the course of being extracted. For this purpose, according to a variant of the invention, the user introduces a slender tool 212, for example a hairpin or a paper clip, into the hole 211 cut in the bottom of the base B and causes the pan 206 to be extracted by pushing thereon. Subsequently, a new pan 206 may be placed in position in the cavity 202 simply by pressure.

Figure 6A:
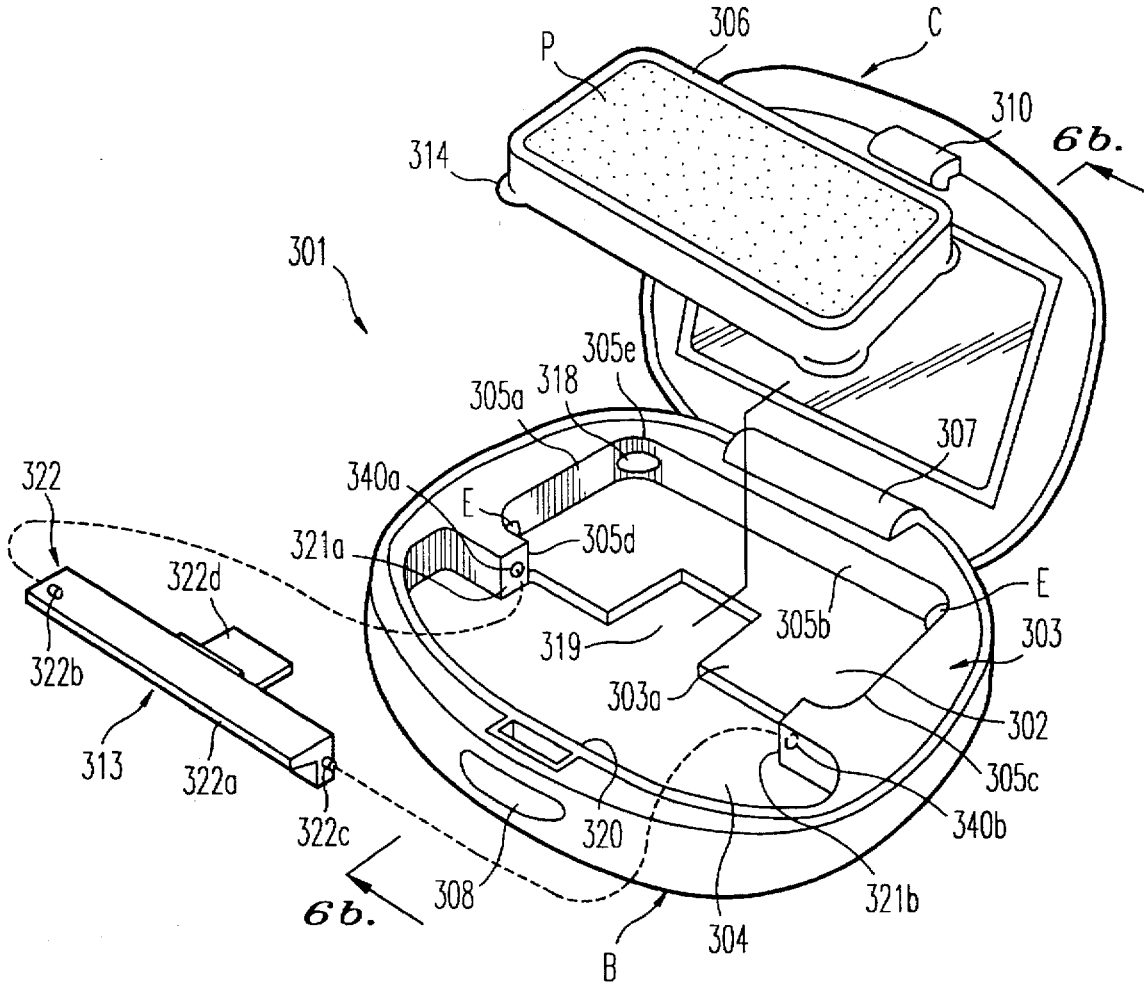
FIG. 6*a* is a view in an exploded perspective of a unit in accordance with a variant of the embodiment of the invention, comprising an integrated means for the extraction of the solid or semi-solid product.
Figure 6B:
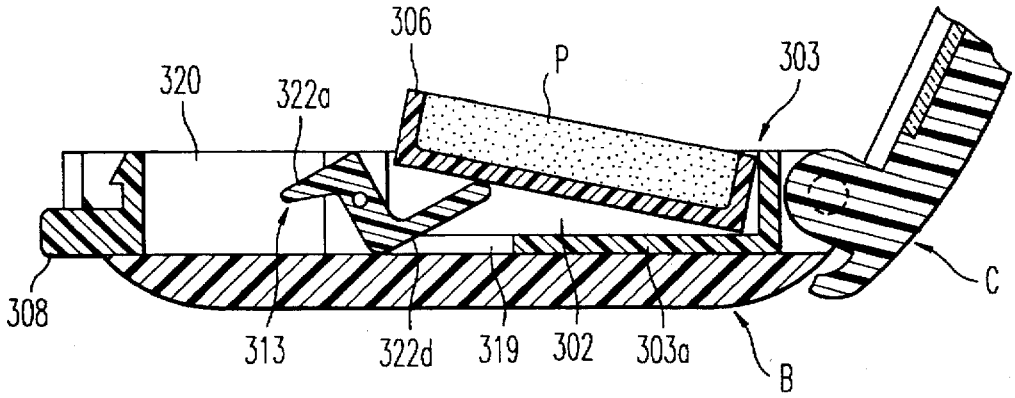
FIG. 6*b* shows a longitudinal section along line X—X of FIG. 6*a*, showing a product pan in the stage of being extracted by means of a lever.

FIGS. 6*a* and 6*b* show, according to another variant of the invention, a make-up unit 301 having an integrated means 313 for the extraction of the pan 306. This unit is constituted by a base B, a lid C, and an intermediate plate 303 with a bottom 303*a*. The parts that are the same as those in FIG. 1, or that perform a similar function, bear the reference numerals of this Figure, increased by 300. Their description will not be repeated in full.

The base B has the above-noted intermediate plate 303 wherein there is arranged a cavity 302 intended to receive the pan 306, as well as a recess 320 intended to contain an applicator. This cavity 302 is delimited by a bottom 303*a* of the plate 303 and four side walls 305*a*–305*d*. The wall 305*d* which separates the cavity 302 from the recess 320 has been cut out in its central zone, this cutout delimiting two opposed portions 321*a*, 321*b*. Blind holes 340*a*, 340*b* have been arranged in these portions for receiving the pivot pins 322*b*, 322*c* of a lever 322 which constitutes the means 313 for the extraction of the pan 306. This lever is pivotably mounted.

The bottom 303*a* of the plate 303 has a slot 319 allowing the bottom 304 of the base B to show. An arm 322*d* of the lever is accommodated in this slot 319, so that its free end bears against a portion of the bottom of the pan 306 when the latter is in position. The portion on the opposite side to the arm 322*d* has an arm 322*a* whose actuation by the user causes the pan 306 to be extracted from the cavity 302 by pivoting.

The four corners 305*e* of the cavity 302 are each provided with elastic holding means E obtained by an elastic ring 318 ensuring the hold of the pan 306 in the cavity 302. The pan 306 may have extra thicknesses or beads 314 intended to be accommodated between the ring 318 and the bottom 303*a* of the plate so as to ensure a more solid hold in a fully flexible manner. This extra thickness may, of course, be obtained on the pans conforming to the preceding embodiments.

FIGS. 7 and 8 illustrate make-up compacts 401 and 501 respectively wherein the elastic holding means take the form of an annular peripheral channel 418 and 518. These channels 418, 518 are mounted astride the upper edge of the base B (FIG. 7) and the upper edges of the plate 503 and the base B (FIG. 8), so as to block the product pans 406, 506 from the top. The latter are elastically held by catch engagement respectively in the base B (FIG. 7) and the plate 503 by means of a lip 426 or 526 of the channel 418 or 518 directed towards the bottom of the pan 406, 506 resting on its upper edge. The channels 418 and 518 are, for example, made of molded-on elastomers with a view to the compensation of any possible play and an easy positioning of the pans 418 and 518; provision may be made for a compressible means 424 and 524 respectively, made of a deformable material, between the pan 406 and the base B of the compact 401 (FIG. 7), or between the intermediate plate 503 and the base B of the compact 501 (FIG. 8). The compressible means 424, 524 compensate for play and/or protect against vibrations.

The compressible means 424 takes the form of a flexible elastomeric foam, and the means 524 the form of molded-on flexible elastomeric spikes.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A unit for packaging and presenting at least one product, the unit comprising:

a supporting element having a cavity for receiving the at least one product, the cavity being delimited by a substantially flat bottom and a side wall which is substantially perpendicular to the substantially flat bottom, said side wall having slots;

and an elastic holding means for ensuring a holding in position of the at least one product in the cavity, permitting an extraction of the at least one product from the cavity, and a setting in position of a new product, said elastic holding means being flexible, shock resistant and deformable in all directions, said elastic holding means being partially situated within said side wall which delimits the cavity and having a portion which protrudes through said slots, wherein said portion of the elastic holding means contacts said at least one product through said slots.

2. A unit according to claim 1, wherein the elastic holding means comprises an O-ring.

3. A unit according to claim 1, wherein the elastic holding means comprises a material molded-on by injection.

4. A unit according to claim 1, wherein the elastic holding means is a thermoplastic elastomer having an elastomeric material.

5. A unit according to claim 4, wherein the elastomeric material is in the form of a foam.

6. A unit according to claim 5, wherein the elastomeric material has a hardness chosen within the range of 15 Shore A to 25 Shore D.

7. A unit according to claim 4, wherein the elastomeric material is selected from elastomers of silicone, natural rubbers, synthetic rubbers, elastomers of polyethylene/polypropylene/polyester, elastomers of polyurethane, elastomers of polystyrene, and ether amide block elastomers.

8. A unit according to claim 1, wherein the supporting element is provided with a hole for extracting the at least one product, the hole permitting an insertion of a slender or pointed element to produce the extraction of the at least one product when the at least one product has to be changed.

9. A unit according to claim 1, further comprising a compressible means beneath the at least one product and between the supporting element and said at least one product to compensate for play and protect against vibrations.

10. A unit according to claim 1, wherein the at least one product is of a solid consistency.

11. A unit according to claim 1, wherein the at least one product is of a semi-solid consistency.

12. A unit for packaging and presenting at least one product, the unit comprising:

a supporting element having a cavity for receiving the at least one product, the cavity being delimited by a substantially flat bottom and a side wall which is substantially perpendicular to the substantially flat bottom, wherein said side wall has slots therein, and the at least one product is accommodated in at least one pan placed in the cavity; and an elastic holding means for ensuring a holding in position of the at least one pan in the cavity, permitting an extraction of the at least one pan from the cavity, and a setting in position of a new pan, said elastic holding means being flexible, shock resistant and deformable in all directions, said elastic holding means being situated partially within said side wall which delimits the cavity and being visible through said slots, said elastic holding means protruding through said slots so as to contact said at least one pan.

13. A unit according to claim 12, wherein the pan is provided with a catch engagement bead which is accommodated between the elastic holding means and the bottom.

14. A unit according to claim 12, wherein the supporting element is provided with a pivoting means for the extraction of the at least one product.

15. A unit according to claim 14, wherein the pivoting means is a lever, the lever comprising a first arm which is capable of being actuated by a user, and a second arm which is accommodated beneath a zone of the pan and is capable of raising the pan when the first arm is actuated.

16. A unit according to claim 12, wherein said at least one product is of a solid consistency.

17. A unit according to claim 12, wherein said at least one product is of a semi-solid consistency.

18. A unit according to claim 12, wherein the elastic holding means comprises a material molded-on by casting.

19. A unit according to claim 12, wherein the elastic holding means is a vulcanized elastomer having an elastomeric material.

20. A unit for packaging and presenting at least one product, the unit comprising:

a base member having a side wall and a bottom portion which defines a first cavity;

a plate member having at least one second cavity for receiving the at least one product, said plate member being positioned in the first cavity of the base member; and an elastic holding means for ensuring a holding in position of the plate member in the first cavity, permitting an extraction of the plate member from the first cavity, and a setting in position of a new plate member, said elastic holding means being flexible, shock resistant and deformable in all directions, said elastic holding means being situated partially within said side wall of the base member and protruding through slots on the side wall of the base member so as to contact said plate member.

21. A unit according to claim 20, wherein the at least one product is positioned in at least one pan, said at least one pan being positioned within the at least one second cavity of the plate member.

22. A unit according to claim 21, wherein the at least one second cavity of the plate member comprises a further elastic holding means for holding said at least one pan in said at least one second cavity.

23. A unit according to claim 20, wherein the at least one product is of a solid consistency.

24. A unit according to claim 20, wherein the at least one product is of a semi-solid consistency.

25. A unit according to claim 20, wherein the elastic holding means comprises a material molded-on by casting.

26. A unit according to claim 20, wherein the elastic holding means is a vulcanized elastomer having an elastomeric material.

27. A unit for packaging and presenting at least one product, the unit comprising:

a supporting element having a cavity for receiving the at least one product, the cavity being delimited by a substantially flat bottom and a side wall which is substantially perpendicular to the substantially flat bottom;

a pan for accommodating the at least one product, said pan being placed in the cavity;

an elastic holding means for ensuring a holding in position of the pan in the cavity, permitting an extraction of the pan from the cavity, and a setting in position of a new pan, said elastic holding means being flexible, shock resistant and deformable in all directions, said elastic holding means being situated between at least one portion of the side wall which delimits the cavity and the pan; and a catch engagement bead protruding from the pan and accommodated between the elastic holding means and the substantially flat bottom.

28. A unit according to claim 27, wherein said at least one product is of a solid consistency.

29. A unit according to claim 27, wherein said at least one product is of a semi-solid consistency.

30. A unit for packaging and presenting at least one product, the unit comprising:

a supporting element having a cavity for receiving the at least one product, the cavity being delimited by a substantially flat bottom and a side wall which is substantially perpendicular to the substantially flat bottom;

accommodating means for accommodating said at least one product, said accommodating means being located in the cavity;

an elastic holding means for ensuring a holding in position of the accommodating means in the cavity, permitting an extraction of the accommodating means from the cavity, and a setting in position of a new accommodating means, said elastic holding means being flexible, shock resistant and deformable in all directions, said elastic holding means being situated between at least one portion of the side wall which delimits the cavity and the accommodating means, said elastic holding means defining an annular peripheral channel which includes a portion that extends above said accommodating means.

31. A unit according to claim 30, wherein said at least one product is of a solid consistency.

32. A unit according to claim 30, wherein said at least one product is of a semi-solid consistency.

* * * * *